United States Patent [19]

Hori

[11] Patent Number: 4,877,345

[45] Date of Patent: Oct. 31, 1989

[54] MARGIN SETTING MEANS FOR A PRINTER

[75] Inventor: Hisanobu Hori, Fukuoka, Japan

[73] Assignee: Matsushita Electric Industrial Co., Ltd., Osaka, Japan

[21] Appl. No.: 188,144

[22] Filed: Apr. 20, 1988

Related U.S. Application Data

[63] Continuation of Ser. No. 849,674, Apr. 9, 1986, abandoned.

[30] Foreign Application Priority Data

Apr. 10, 1985 [JP] Japan ..... 60-75649

[51] Int. Cl.[4] ..... B41J 29/42

[52] U.S. Cl. ..... 400/342; 400/279

[58] Field of Search ..... 400/70, 76, 279, 342, 400/343, 344, 345, 346, 347, 348, 349, 350, 351, 708, 708.1

[56] References Cited

U.S. PATENT DOCUMENTS

| | | | |
|---|---|---|---|
| 3,932,842 | 1/1976 | Kennavane | 400/70 X |
| 4,031,996 | 6/1977 | Busch | 400/279 |
| 4,152,083 | 5/1979 | Kostoff, II | 400/342 |
| 4,540,299 | 9/1985 | Yamada | 400/342 |
| 4,589,785 | 5/1986 | Sato | 400/76 X |

FOREIGN PATENT DOCUMENTS

| | | | |
|---|---|---|---|
| 2937488 | 4/1981 | Fed. Rep. of Germany | 400/342 |
| 0144989 | 11/1981 | Japan | 400/342 |
| 0004789 | 1/1982 | Japan | 400/342 |
| 0098886 | 6/1984 | Japan | 400/342 |
| 0145178 | 8/1984 | Japan | 400/279 |
| 0159378 | 9/1984 | Japan | 400/279 |
| 0015187 | 1/1985 | Japan | 400/279 |
| 0063185 | 4/1985 | Japan | 400/342 |
| 0104381 | 6/1985 | Japan | 400/342 |
| 0168672 | 9/1985 | Japan | 400/279 |
| 0233578 | 10/1986 | Japan | 400/76 |

*Primary Examiner*—Ernest T. Wright, Jr.
*Attorney, Agent, or Firm*—Wenderoth, Lind & Ponack

[57] ABSTRACT

A printer having a controller which moves a carriage according to the operation of a switch, and stores the location of the carriage at the moment when a margin setting switch has been depressed as margin location data. In case of a connection to an external data source, the setting of a margin location can be done at any time except when the printer is in a printing mode.

4 Claims, 3 Drawing Sheets

MARGIN SETTING MEANS FOR A PRINTER

This application is a continuation, of now abandoned application Ser. No. 849,674, filed Apr. 9, 1986, now abandoned.

BACKGROUND OF THE INVENTION

This invention relates to a printer for printing according to data sent from an external data source such as a computer. The previously used known printers for printing the output data from a computer and the like, usually print characters according to the character code sent from a computer connected thereto.

The setting of a margin, which is the starting position and the ending position of the printing of one line, is performed according to the steps mentioned below. First, an operator places a printing sheet on the platen of the printer, in such a manner that the left edge of the sheet meets with the left end of the platen. Next, the operator causes the printer to print characters stored therein. Then, the operator counts the number of characters existing between the left edge of the sheet and the left margin position and also counts the number of characters existing between the left edge of the sheet and the right margin position. The operator then enters special printing commands, which correspond to the numbers of characters previously counted, into the computer. The special printing commands corresponding to both margins are fed to the printer from the computer when the print commands are sent. As a result, the setting of the margins is completed.

After the setting of the margins, the printer prints the characters between the left margin position and the right margin position according to the margin data.

But, if the operator places a new sheet on the platen, and if the left edge of the sheet doesn't meet with the left end of the platen, the printing is not performed with the margin position at the expected location on the sheet. The printing is performed with the margin position shifted from the expected position because the margin position data doesn't indicate a distance from the left edge to the desired margin position of the sheet but rather indicates the distance from the left end position of the print area to the margin position of the sheet on the platen.

As stated above, in such a usual printer, in the case of a test printing for setting the margin, it is necessary to always set the sheet at the same position as the sheet used in the trial printing, for example, setting the left edge of sheet in accordance with the left end of platen. In addition, there is a big burden for the operator in that the operator must review the result of the trial printing and set the data of the margin position, and must transform the data into the special printing commands for the printer by way of the computer. It is impossible to set the margin in the case where the computer is in its operating mode since the margin setting is done by the computer. For example, in the case where the operater wishes to print the data calculated by the computer, even if the operator wants to change the margin, the operator cannot change the margin without stopping the computer program.

SUMMARY OF THE INVENTION

A primary object of this invention is to provide a printer which doesn't need an operator to set a sheet to a restricted position accurately. Another object of this invention is to provide a printer which is easy to operate and which does not require an external data source to send commands needed for margin setting. Another object of this invention is to provide a printer that is able to change the setting of a margin at any time except when the printer is in a printing mode in which the printer is connected to an external data source.

The printer according to this invention includes some of the elements mentioned below for achieving the objects mentioned above.

A receiving unit receives printing information, such as a character code, from a computer.

A printing control unit controls a carriage and a printing means mounted on the carriage according to the printing information, such as a character code, read out from a memory.

A margin setting mode signal generating unit designates a setting mode that corresponds to either a right or a left margin setting mode.

A move carriage signal generating unit generates the signals used for driving the carriage so as to move it to its setting position in the margin setting mode.

A carriage driving unit moves the carriage according to the move carriage signal.

A margin position storing unit detects the position of the carriage and stores the position data as right or left margin position data.

DESCRIPTION OF THE PREFERRED EMBODIMENT

Figure 1:
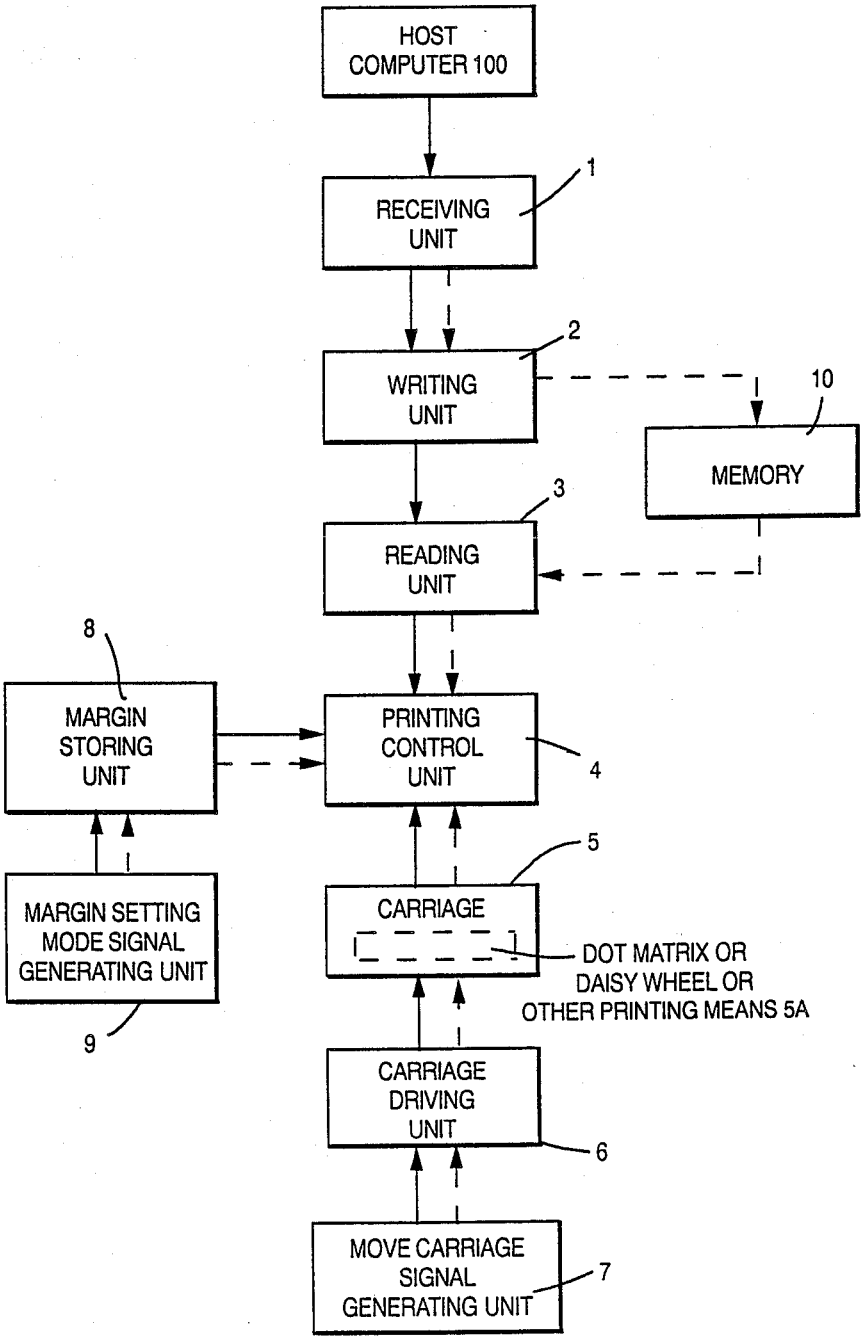
FIG. 1 is a schematic diagram showing the functional block diagram of the printer embodying the present invention.

Referring to FIG. 1, a receiving unit 1 is coupled to a host computer 100, and printing data in the form of character codes are fed from the computer 100 to the receiving unit 1. A writing unit 2 is coupled to the receiving unit 1 and writes the printing data, such as alphabetic or numeric characters, etc., in the memory 10. A reading unit 3 receives control signals from the writing unit 2, and reads the data stored in the memory 10, in such a fashion as is suitable for printing. A margin setting mode signal generating unit 9 is connected to the margin storing unit 8 so as to cause the control mode of the printer to be a margin setting mode. A margin storing unit 8 stores margin position data, in the mode that is designated by the margin setting mode signal generating unit 9. A printing control unit 4 controls a carriage 5 and a printing means 5A mounted on the carriage 5, for printing, according to the printing data read from the memory 10 by the reading unit 3. In this invention, a conventional dot matrix printing means, or a so called daisy wheel printing means or other printing means can be utilized. A move carriage signal generating unit 7 generates signals for making the carriage 5 move in the margin setting mode designated by the margin setting mode signal generating unit 9. A carriage drive unit 6 which is coupled to the move carriage signal generating unit 7 makes the carriage 5 move according to the signals from the move carriage signal generating unit 7.

The printing data received by the receiving unit 1 in the form of character code data from a computer 100 or the like, are stored in the memory 10 by the writing unit 2. The data stored in the memory 10 is read out by reading unit 3. According to this data, the printing control unit 4 moves the carriage 5 and feeds the data to the printing means 5A mounted on the carriage 5 and carries out the printing. In order to set the margin, which is one of the printing control data signals, in the first step, an operator places the printer in the margin setting mode, and makes the above carriage signal generating unit 7 generate a move carriage signal. This signal is sent to the carriage driving unit 6, and the carriage 5 then moves to the position where the operator wants the margin to be set. When the operator depresses a margin setting switch 16 (FIG. 2), the margin storing unit 8 stores the data representing the position where the carriage 5 is at this time, according to the mode designated by the margin setting mode signal generating unit 9. After this, the printing control unit 4 initiates the printing according to this data. In FIG. 1, a solid line indicates a flow of control signals, and a dotted line indicates a flow of data signals.

Figure 2:
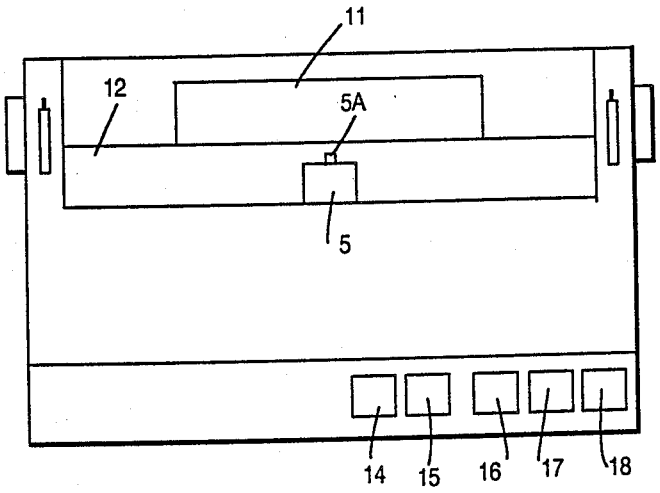
FIG. 2 is a plan view of the printer embodying the present invention.

Referring to FIG. 2, element 11 indicates a sheet for printing. A platen 12 supports the sheet 11. The carriage 5 carries a printing means 5A, and is able to move along the platen 12. A left margin setting mode switch 14 places the printer in the left margin setting mode, for setting the left margin. A right margin setting mode switch 15 places the printer in the right margin setting mode, for setting the right margin. A margin setting switch 16 causes the margin storing unit 8 to store the position data of the carriage 5 at the time when the margin setting switch 16 is depressed, as left or right margin position data.

By depressing a left move switch 17, an operator can move the carriage 5 to the left when the printer is in the left or right margin setting mode.

By depressing a right move switch 18, an operator can move the carriage 5 to the right when the printer is in the left or right margin setting mode.

The left margin setting mode switch 14, the right margin setting mode switch 15, the margin setting switch 16, the left move switch 17 and the right move switch 18 are located on the front of the printer.

To set the margin, an operator first sets the sheet 11 at a suitable position on the platen 12. Next, if the operator wishes to set the right margin, the right margin setting mode switch 15 is depressed. The right move switch 18 is then depressed, and the carriage 5 is moved to the right. When the carriage 5 reaches a suitable position, the right move switch 18 is no longer depressed, and the carriage 5 stops. If the carriage 5 moves beyond the suitable position, the left move switch 17 is depressed, and the carriage 5 is moved to the left. After the carriage 5 has reached the suitable position, the margin setting switch 15 is depressed, and the margin is set. According to this operation, the position data of the carriage 5 at the time when the margin setting switch 16 is depressed is stored in the margin storing unit 8 shown in FIG. 1 as the right margin position.

To set the left margin, in the same way as the setting operation of the right margin, the left margin setting mode switch 14 is first depressed, and the carriage 5 is moved to the suitable position by the right move switch 18 and the left move switch 17, and then the margin setting switch 16 is depressed. According to this operation, the position data of the carrier 5 at the time when the margin setting switch 16 is depressed is stored in the margin storing unit 8 shown in FIG. 1 as the left margin position.

Figure 3:
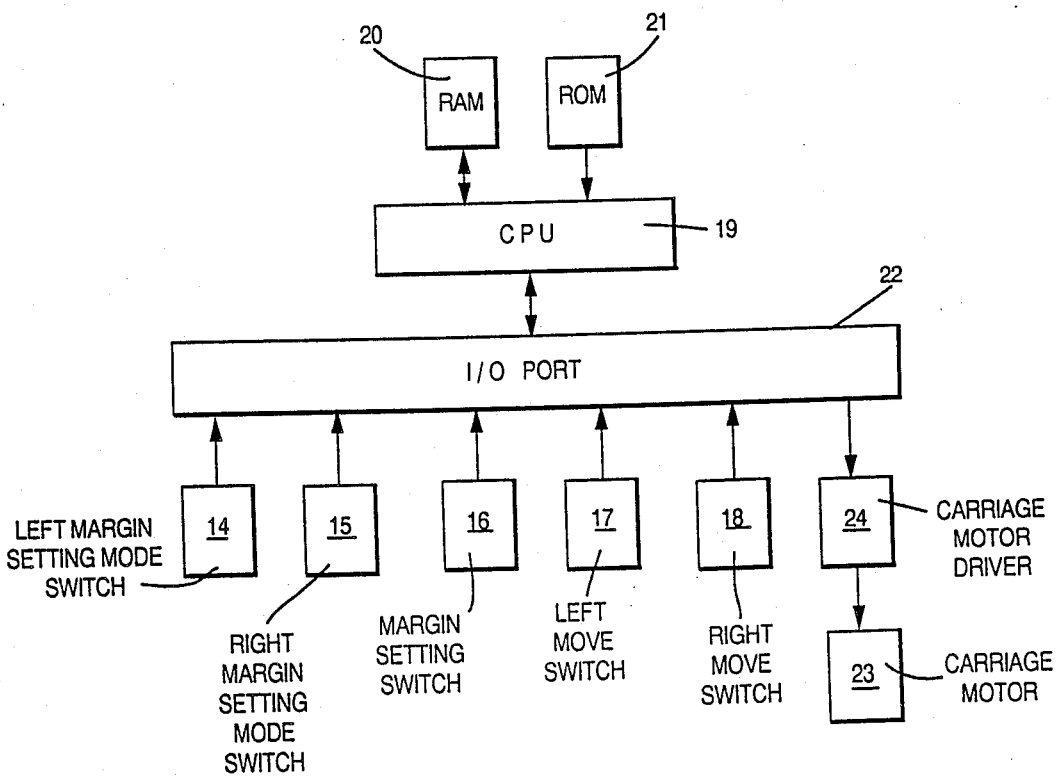
FIG. 3 is a schematic diagram showing the electronic circuit block diagram of the printer embodying the present invention.

FIG. 3 shows the electronic circuit block diagram embodying this invention. Referring to FIG. 3, a central processing unit 19, such as a microprocessor (referred to as CPU hereinafter) is connected to a random access memory 20 (referred to as a RAM hereinafter) and a read only memory 21 (referred to as a ROM hereinafter). Furthermore, CPU 19 is connected to an input output port 22 (referred to as an I/O port hereinafter). The I/O port 22 is connected to a carriage motor driver 24 which controls a carriage motor 23 for driving the carriage 5. The carriage driving unit 6 of FIG. 1 corresponds to the carriage motor driver 24 and carriage motor 23 of FIG. 3. The left margin setting switch 16, left move switch 17, and right move switch 18 are also connected to the I/O port 22. To move the carriage 5, the CPU 19 sends signals to the carriage motor driver 24. The carriage motor driver 24 causes the carriage motor 23 to rotate and the carriage 5 moves.

To set the margin, the CPU 19 sequentially detects the state of the left margin setting mode switch 14 and the right margin setting mode switch 15 according to the program stored in the ROM 21 and detects whether or not it is in the left margin setting mode, and whether or not it is in the right margin setting mode. The CPU 19 then scans the margin setting switch 16, and if the margin setting switch 16 is depressed, then the CPU 19 writes the position data of the carriage 5 at this time as margin position data in the RAM 20. The CPU 19 controls the printing according to the data written in the RAM 20 in the way mentioned above.

Figure 4:
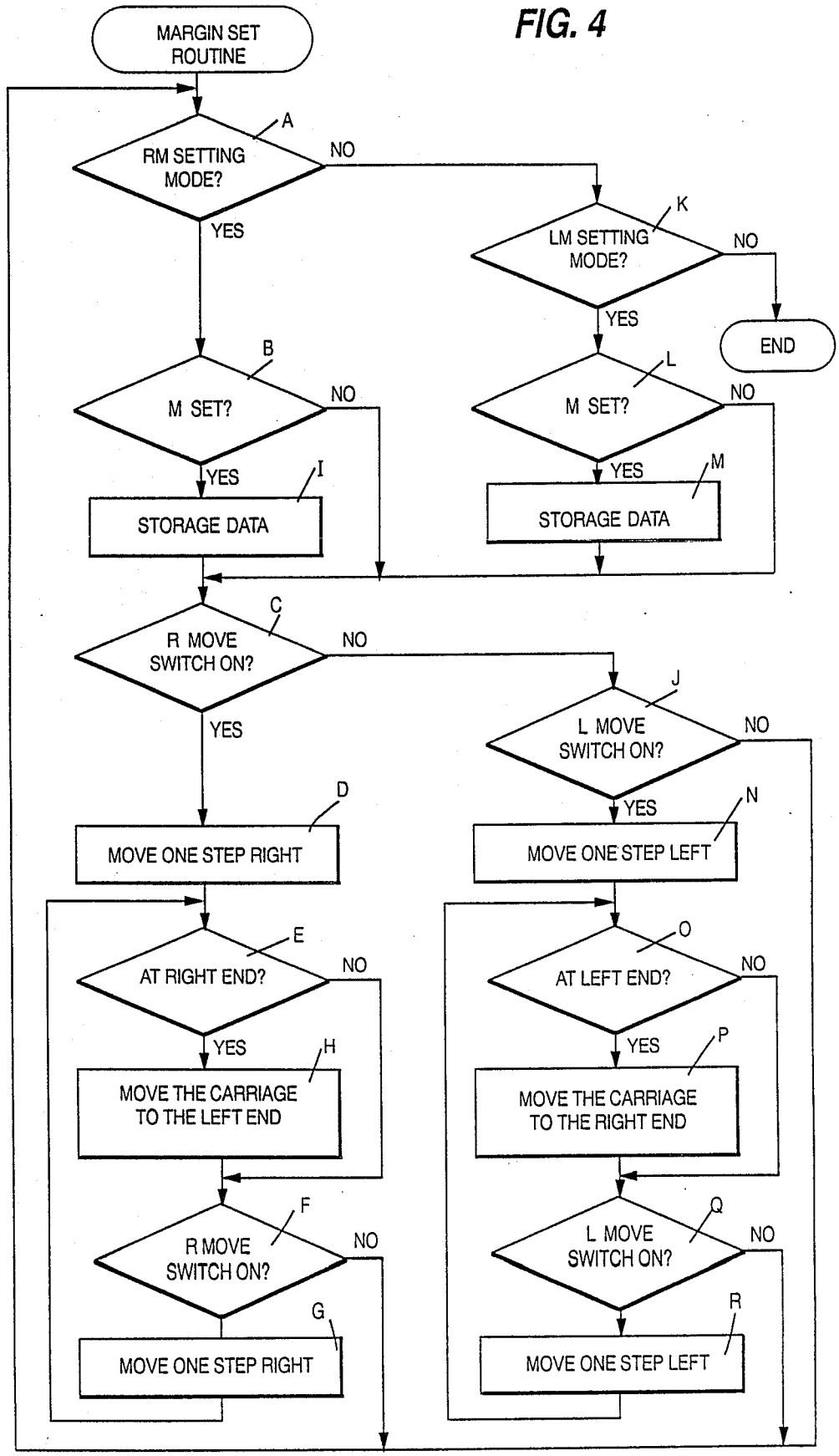
FIG. 4 is a flowchart showing the essential decision making steps utilized in this invention.

FIG. 4 shows a flowchart of the logical operation for setting the margin by the printer embodying the present invention. First, in step A, the CPU 19 detects whether or not it is in right margin setting mode, by detecting the state of the right margin setting mode switch 15. In the scanning operation, if the right margin setting mode switch 15 is turned on, the CPU 19 determines that it is in the right margin setting mode, and detects the state of the margin setting switch 16 (in step B), and then determines whether or not the margin setting switch 16 is turned on. If the margin setting switch 16 is turned on (in step I), the CPU 19 stores the position data of the carriage 5 in the RAM 21 as right margin position data. If the margin setting switch 16 is not turned on, the CPU 19 detects the state of the right move switch 18, and determines whether or not the right move switch 18 is turned on (in step C). If the right move switch 18 is turned on (in step D), the CPU 19 moves the carriage 5 one step, and waits for a while. The CPU 19 then determines whether the carriage 13 has arrived at the right end of the total range of movement (in step E). Then, if the carriage 5 has arrived at the right end, the CPU 19 moves the carriage 5 to the left end of the total range of movement (in step H) and waits for a while. Then, if the carriage 5 doesn't arrive at the right end, the CPU 19 determines whether or not the right move switch 18 is turned on (in step F). If the switch 18 is turned on, the CPU 19 moves the carriage 5 more to the right (in step G). If the right move switch 18 isn't turned on, the CPU 19 returns to step A. If the right move switch 18 isn't turned on (in step C), the CPU 19 determines whether or not the left move switch 17 is turned on (in step J). Then, if the switch 17 is turned on, the CPU 19 moves the carriage 5 to the left side in the same way as it moved the carriage 5 to the right side (in steps N, O, P, Q and R). Furthermore, the CPU 19 determines whether or not the left move switch 17 is turned on in the same way (in step Q), and if the switch 17 is not turned on, the CPU 19 returns to step A. Then, if the right margin setting mode hasn't been cancelled, the CPU 19 determines whether or not the margin setting switch 16 is turned on (in step B), and if the switch 16 is turned on, the CPU 19 writes the position data of the carriage 5 at this time in the RAM 20 as right margin position data. Next, the CPU 19 goes to step C at this time, if the right move switch 18 is turned off. In step J, if the left move switch 17 isn't turned on, the CPU 19 returns to step A.

In setting the left margin, an operator turns on the left margin setting mode switch 14. After moving the carriage 13 to the objective position, the margin setting switch 16 is turned on in the same way as setting the right margin.

The practical operation is as follows. In setting the right margin, an operator places the system in the margin setting mode by depressing the right margin setting mode switch 15, and moves the carriage 5 to the suitable position by operating the left move switch 17 or the right move switch 18. Next, the right margin setting switch 16 is operated, and the CPU 19 writes the position data of the carriage 5 as the right margin position data in the RAM 20 at the time that the switch 16 is depressed.

In the same way, in setting the left margin, the operator first places the system in the left margin setting mode by depressing the left margin setting mode switch 14, and moves the carriage 5 to the suitable position by operating the left move switch 17 or the right move switch 18. Next, the margin setting switch 16 is operated, and the CPU 19 writes the position data of the carriage 5 as the left margin position data in the RAM 20 at the time that the margin setting switch 16 is depressed.

Steps K, L, M, N, O, P and R respectively correspond to steps A, B, I, D, E, H and G except that they refer to the left margin rather than the right margin and a detailed description thereof has been omitted for the sake of brevity.

I claim:

1. A printer for operating with a host computer and having a movable carriage, said printer comprising:

a receiving means for receiving control codes and printing character data from the host computer;

a memory means operatively connected to said receiving means for storing and subsequently reading out said control codes and printing character data received by said receiving means from the host computer;

a control means operatively connected to said memory means and to a carriage driving means for moving the carriage in accordance with said control codes and printing character data;

a margin position data storing means operatively connected to said control means for storing margin position data;

a move carriage signal generating means operatively connected to said control means for manually moving said carriage in response to manual inputs by an operator;

a margin setting signal generating means operatively connected to said margin position data storing means for providing margin setting signals to said margin position data storing means and for providing a margin setting mode signal to said control means via said margin position data storing means, said signals being provided in response to manual inputs by said operator;

wherein said receiving means and memory means and control means and margin position data storing means and move carriage signal generating means and margin setting signal generating means recited above are arranged such that said operator first provides a manual input to said margin setting signal generating means to cause said receiving means and memory means and control means and margin position data storing means and move carriage signal generating means and margin setting signal generating means recited above to generate said margin setting mode signal so as to place the printer in a margin mode and said operator then manually moves said carriage to a desired margin position by providing a manual input to said move carriage signal generating means and then causes said margin position data storing means to store said carriage position as margin position data by providing a manual input to said margin setting signal generating means so as to cause said receiving means and memory means and control means and margin position data storing means and move carriage signal generating means and margin setting signal generating means recited above to generate margin setting signals to be fed to said margin position data storing means.

2. A printer as recited in claim 1, wherein said margin signal generating means comprises a margin setting mode switch means and margin setting switch means for respectively receiving said manual inputs from said operator for generating said margin setting mode signal and margin setting signals.

3. A printer as recited in claim 1, wherein said move carriage signal generating means comprises carriage move switch means for receiving manual inputs from said operator.

4. A printer as recited in claim 2, wherein said move carriage signal generating means comprises carriage move switch means for receiving manual inputs from said operator.

* * * * *